US007471197B2

(12) United States Patent
McRae

(10) Patent No.: US 7,471,197 B2
(45) Date of Patent: Dec. 30, 2008

(54) PERIMETER WALL SECURITY SYSTEM

(75) Inventor: John McRae, 5 Haworth Dr., Bootle, Liverpool L20 6EJ (GB)

(73) Assignee: John McRae, Liverpool (GB)

( * ) Notice: Subject to any disclaimer, the term of this patent is extended or adjusted under 35 U.S.C. 154(b) by 432 days.

(21) Appl. No.: 10/580,905

(22) PCT Filed: Dec. 8, 2004

(86) PCT No.: PCT/GB2004/005192

§ 371 (c)(1),
(2), (4) Date: May 26, 2006

(87) PCT Pub. No.: WO2005/057513

PCT Pub. Date: Jun. 23, 2005

(65) Prior Publication Data

US 2007/0120696 A1 May 31, 2007

(30) Foreign Application Priority Data

Dec. 11, 2003 (GB) ..... 0328664.8

(51) Int. Cl.
*G08B 13/00* (2006.01)

(52) U.S. Cl. ..... 340/541; 340/545.6

(58) Field of Classification Search ..... 340/545.6, 340/550, 564, 565, 551, 552
See application file for complete search history.

(56) References Cited

U.S. PATENT DOCUMENTS 5,461,364 A 10/1995 Sanford, Jr. et al.
5,548,275 A * 8/1996 Shambayati et al. ..... 340/573.6

FOREIGN PATENT DOCUMENTS

| | | |
|---|---|---|
| EP | 0298320 | 6/1988 |
| GB | 1391178 | 4/1975 |
| GB | 1558707 | 1/1980 |
| GB | 2 171 232 A | 8/1986 |
| GB | 1354057 | 5/1994 |
| GB | 2 349 727 A | 11/2000 |
| GB | 2349727 A * | 11/2000 |
| JP | 09185775 | 7/1997 |
| WO | WO 89/01212 | 2/1989 |

OTHER PUBLICATIONS

Frasca Derek Anthony, Detecting Presence of intruders using . . . Derwent Abstract 1994-264446, 1992.

* cited by examiner

*Primary Examiner*—George A Bugg
*Assistant Examiner*—Shirley Lu
(74) *Attorney, Agent, or Firm*—Klauber & Jackson, LLC

(57) ABSTRACT

A security system comprising an attachment (1) for mounting on a wall top, having a first part (4) that is fixable to the wall and a second part (6) that is mounted for relative movement on said first part upon the application of a force thereto whereby movement of the second part generates a signal to activate a visual and/or audible alarm, the second part having at least one pair of opposing members (40*a*, 40*b*) for partially overlapping a side of the first part so as to retain the second part, the second part being sized so as to allow a limited range of movement with respect to said first part without its release therefrom.

34 Claims, 16 Drawing Sheets

PERIMETER WALL SECURITY SYSTEM

CROSS REFERENCE TO RELATED APPLICATIONS

The present application is a National Stage Application claiming the priority of co-pending PCT Application No. PCT/GB2004/005192, filed Dec. 8, 2004, which in turn, claims priority from Great Britain Application Serial No. 0328664.8, filed Dec. 11, 2003. Applicants claim the benefits of 35 U.S.C. § 120 as to the PCT application and priority under 35 U.S.C. § 119 as to the said Great Britain application, and the entire disclosures of both applications are incorporated herein by reference in their entireties.

DESCRIPTION

The present invention relates to an improved security system, particularly a perimeter wall security system.

There are many security systems in existence for protecting property from intruders. House alarm systems, such as those which rely on infra red detectors, are often installed in homes to activate an audible alarm in the event of a break-in. However, such alarm systems may be activated accidentally and may allow entry of the intruder before sounding and thus, may not be activated sufficiently quickly to prevent damage occurring to the property.

Perimeter security systems are also known, but have the disadvantage of being visible to the intruder. Exposed wiring, which is susceptible to vandalism, is usually found fixed to the surface of or around fences, walls and parapets. Vibrations and seismic sensitive devices may also be employed but are prone to false alarms, for example due to heavy traffic, and are expensive. CCTV may be implemented but requires a manned monitoring station which is not feasible for the domestic and more vulnerable market. Broken glass or razor wire may be provided around the perimeter of a property to deter intruders but this is unsightly and hazardous and may result in the owner of the property having to pay out compensation should an innocent person such as a window cleaner, harm himself on the wall.

The Inventor has already developed an improved perimeter wall security system that is able to detect movement in more than one plane, is out of sight and is aesthetically pleasing (GB2349727). However, the system is composed of a large number,of component parts. This is undesirable since it increases the cost of the system and makes it difficult to install and repair.

It is an object of the present invention to. provide an improved security system, particularly a perimeter security system, which overcomes the abovementioned drawbacks.

Accordingly, a first aspect of the present invention provides a security system comprising an attachment for mounting on a wall or other perimeter barrier, the attachment having first and second parts, the first part being fixable to the wall and the second part being mounted for relative movement on said first part upon application of a force thereto whereby movement of the second part generates a signal to activate a visual and/or audible alarm characterized in that the second part has at least one pair of opposing members for partially overlapping a side of the first part so as to retain said second part, the second part being sized so as to allow a limited range of movement with respect to said first part without its release therefrom.

Preferably, force above a certain threshold is required to overlap the members of the second part with a side of the first part and/or to release the second part from the first part. The second part is preferably larger than the first part whereby, in the assembled unit, a space or gap is created between said first and second parts to allow movement of the second part with respect to the first part.

Preferably, the second part is moveable with respect to the first part in more than one plane. More preferably, the second part may move in the horizontal and vertical planes. It is preferable for the second part to be able to recover its original position after removal of the force which causes movement thereof, for example by means of a spring mechanism. Preferably, the means for generating the signal is housed within the interior of the attachment.

Movement of the attachment may activate a visual or audible alarm which may be located on a part of the attachment and/or may be remote therefrom.

The first and second parts may be sprung-mounted with respect to one another to ensure that the parts revert back to their original position upon removal of the force.

Preferably, the first part has an upper side, an underside and opposing side walls. When attached to a wall or other perimeter barrier, the underside lies on the wall top and the side walls run parallel with parallel edges of the wall top. It is preferable for the underside to be solid whilst the upper side may be relieved of material or completely open to expose the interior of the first part.

Preferably, the second part comprises opposing side walls connected by a roof section, the opposing members extending from the free end of each side wall wherein, in the assembled attachment, the opposing side walls lie parallel with the side walls of the first part and the members partially overlap the underside of the first part. Preferably, the second part is sized so as to provide a gap between the upper side of the first part and the roof section of the second part. Alternatively or additionally, the second part is sized so as to provide a gap between the side walls of the first part and the side walls of the second part.

It is preferable for one of the opposing members to be narrower than the other.

In the present invention, it is the inner profile of the second part and the outer profile of the first part that allows engagement of the two to enable a limited range of movement therebetween. Accordingly, the outer profile of the second part may be any desired shape.

More preferably, the first part has side walls connecting two end walls wherein the two end walls lie across the wall top in the installed unit and the side walls align with the edges of the wall top. Preferably, two parallel rims extend from the underside of the first part for abutting opposing edges of the wall. The distance between the. rims is approximately the breadth of the wall. It is preferable for the underside of the first part to be wider than the wall on to which it is mounted such that the first part extends beyond the edge of the wall to enable it to receive the opposing members of the second part. Alternatively, the first part may be mounted on a mounting plate attached to the wall, the first part being wider than the plate.

Preferably, the first part is provided with at least one spring or other compressible object extending upwardly therefrom for supporting the roof section of the second part. More preferably, the at least one spring is housed within a stud provided in the first part. Alternatively, one or more compartments may be provided within the first part for receiving a spring or other compressible object, such as a plastic wishbone. In an alternative embodiment, the first part may be. constructed such as to provide an integral spring. For example, the first part may be provided with projections extending upwardly and curving inwardly from the side and/or end walls, the projections having a degree of elasticity to enable them to move and recover their position upon the application of force thereto. The first part may be provided with means for preventing excessive movement of the springs, such as rubber supports.

Each end wall of the first part is preferably in the form of a trapezoid, with the side walls extending from the non-parallel sides of the trapezoid.

The second part is preferably dimensioned to fit over said first part and engage therewith but retain a degree of movability with respect thereto. Preferably, the second part comprises two sloping walls connected by the roof section and has a rim extending from the free edge of each wall, each rim running parallel with the roof section. It is preferable for one rim to be wider than the opposing rim. An opening is defined by the rims of the side walls. The opening is dimensioned such as to allow the second part to fit over the first part at a particular orientation but require force to interlock the two parts together. Preferably, in the case of the first part being trapezoid in cross-section, the second part has an opening that is larger than the widest cross-sectional area of the first part, being the diagonal distance between the bottom corner and opposing top corner of the first part, but that is smaller than the base or underside of the first part, thereby requiring force to allow disengagement of the second part. The distance between the side walls of the second part relative to the distance between the side walls of the first part is large enough to allow a limited range of movement of the second part with respect of the first part in the horizontal direction. Springs or other biasing means may be provided between the side walls of the second part and the side walls of the first part.

The outer profile of the second part may be of any desired design. Preferably, the outer profile corresponds to the inner profile, preferably having side walls sloping inwardly and a flat roof section but it is to be appreciated that it may be any shape, such as having a V-shaped roof section.

The present invention may further comprise a third part in the form of a cover for attachment to the second part. The inner profile of the third part corresponds to the outer profile of the second part to enable the two parts to fit together. Any conventional means may be provided to secure the two parts together. Preferably, the cover is provided with means for being releasably secured to the second part, for example by means of a snap-fit connection. In this manner, the outer profile of the cover may be provided in any desired design whilst the first and second parts are provided in a standard design.

It is preferable for the first and second parts to be made of a durable, fully or semi-transparent material, such as high impact Perspex™. Alternatively, the parts may be made of pultruded glass reinforced plastic. However, depending on application and/or location, steel or alloy may be used. The third part is preferably made of a stone effect material, such as a resin. It is to be appreciated that suitable fixing means may be provided for securing the first and/or second parts to each other and/or the wall.

Preferably, the first part has an internal cavity for housing the internal components of the security system, such as electronic circuitry. Speakers and/or lights may be provided on the outer surface one or more parts for activation upon detection of any movement of the section.

Any suitable mechanism may be employed to detect movement of the attachment and transmit a signal to activate an alarm, such as magnetic contacts, lasers, electronic pressure pads, ceramic plates, microswitches or tilt switches, vibration/shock sensors, strain gauges and/or load cells. The security system may be powered by an internal battery, solar energy and/or from an external power source.

In a preferred embodiment of the present invention, an air tube is provided between said first and second parts to detect movement therebetween. Preferably, the first part is provided with guides for receiving the air tube which preferably, passes through a series of convolutions in each attachment. The tube is such that the upper surface thereof contacts the inner profile of the second part at spaced apart intervals. Alternatively, a bridging member may be provided between said first and second parts to communicate movement of said second part to the airtube. More preferably, said bridging member sits within the first part and is unable to move laterally with respect thereto. Preferably, the tube is in the general shape of a tube have an inverted U-shaped extension for attaching the tube to the guides.

To this end, a second aspect of the present invention provides a security system comprising an attachment for mounting on a wall or other perimeter barrier, the attachment having first and second parts, the first part being mountable on the wall and the second part being mounted for relative movement on said first part upon application of a force thereto whereby movement of the second part generates a signal to activate a visual and/or audible alarm characterized in that an air line is provided between said first and second parts to detect said movement, said airline being located on guides provided on said first or second parts.

It is to be appreciated that multiple attachments may be connected together to provide a security system that extends around the entire perimeter wall (or other barrier) of a property. Each attachment may be connected to an electric controller having means to preset the audible and/or visible alarm to operate within a specified time period. The circuit may also allow for additional input from another intruder-sensitive device, for example, provided on a door or gate. The electronic circuitry is preferably linked to a control panel, which may be located in the interior of the property and may also be connected to an existing alarm system.

In the case of airtubes being provided between said first and second parts, it is preferable to provide more guides than airtubes. In this manner, one of the airtubes may terminate with an air switch and an additional airtube may be provided on one of the free guides. More preferably, at least some of the guides are provided with slots at or near the entry and/or exit of the first part to enable airtubes to be moved from one guide to another.

For a better understanding of the present invention and to show more clearly how it may be carried into effect, reference will now be made by way of example only, to the accompanying drawings in which.

Figure 14A:
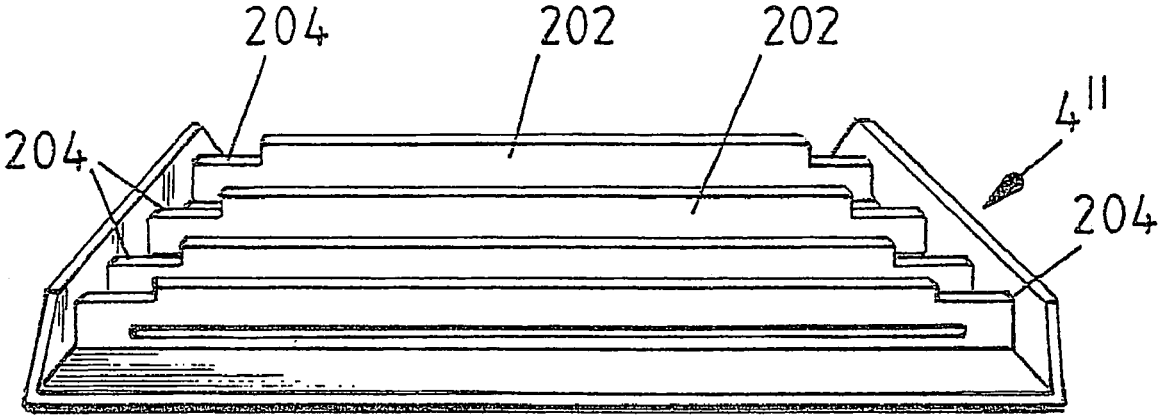
Figure 14B:
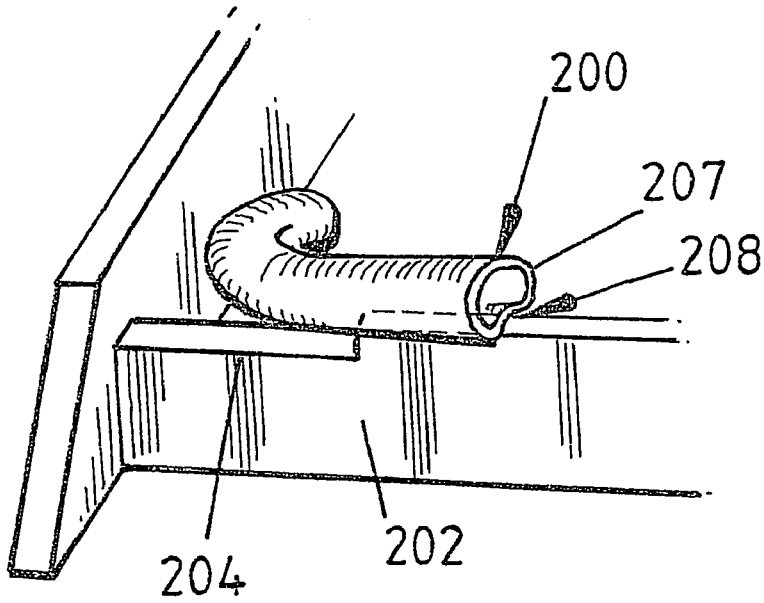

FIG. 14*a* is a side perspective view of a base part according to yet another embodiment of the present invention;

FIG. 14*b* illustrates the mounting of an air tube on the base part shown in FIG. 14*a;*

Figure 15:
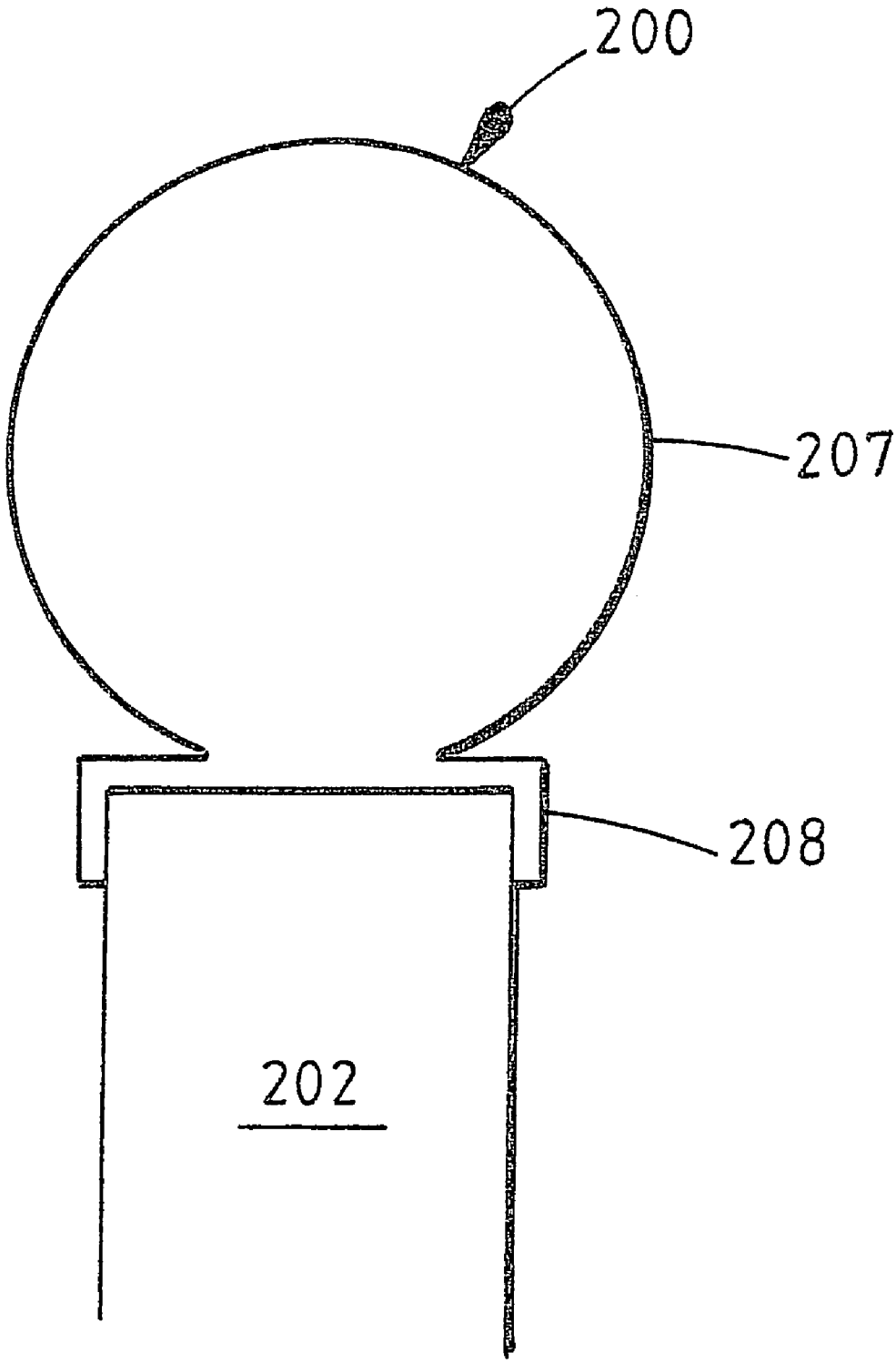
Figure 16:
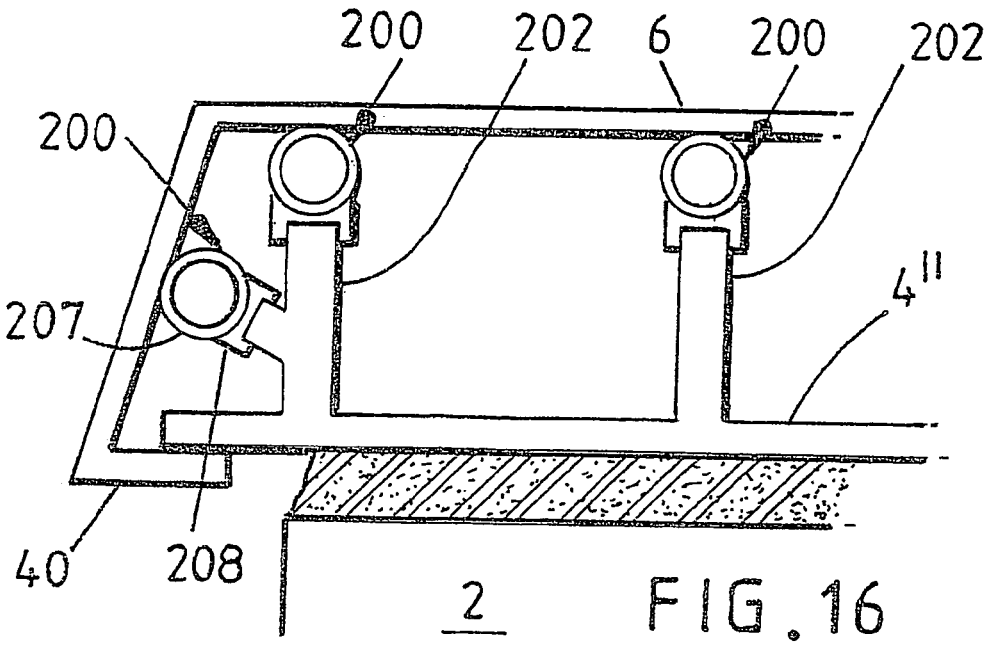
Figure 18:
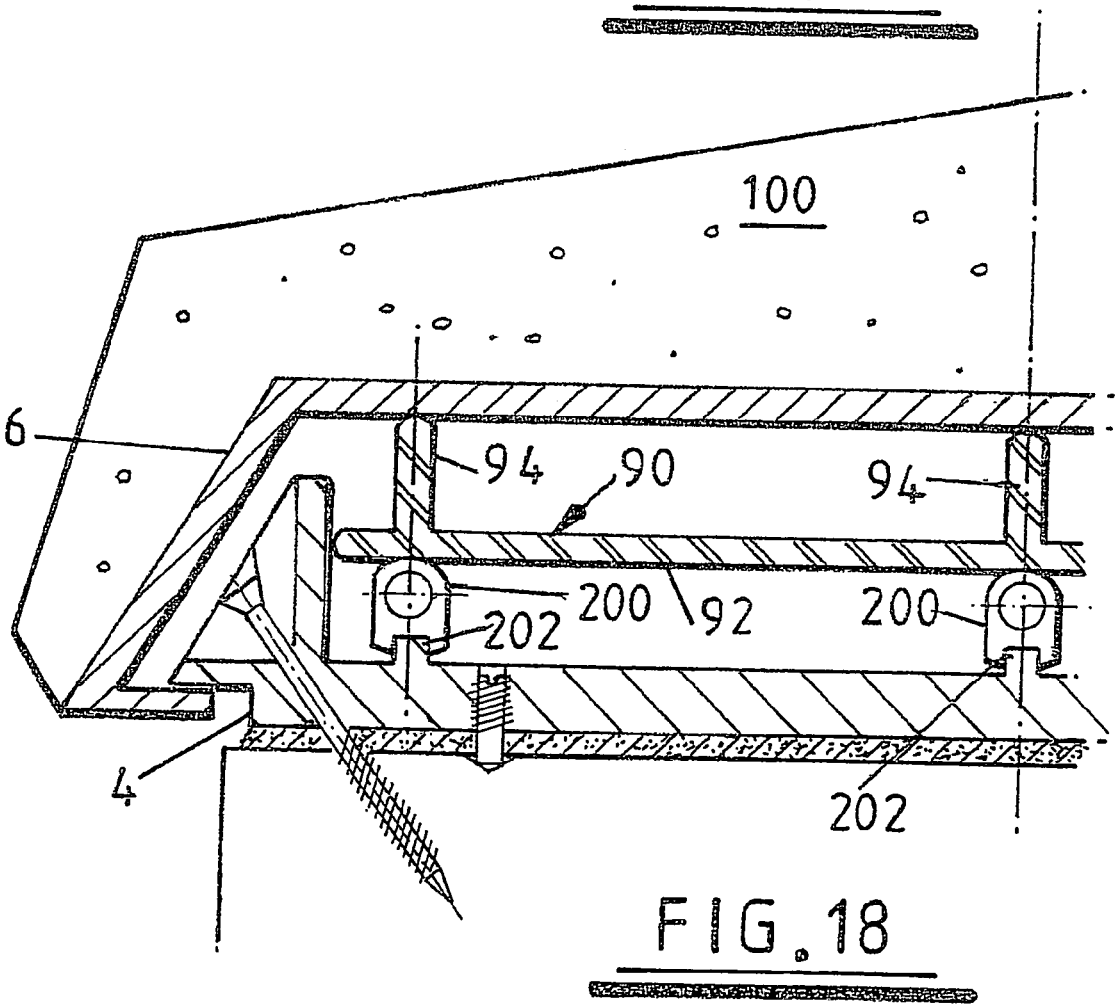
Figure 17:
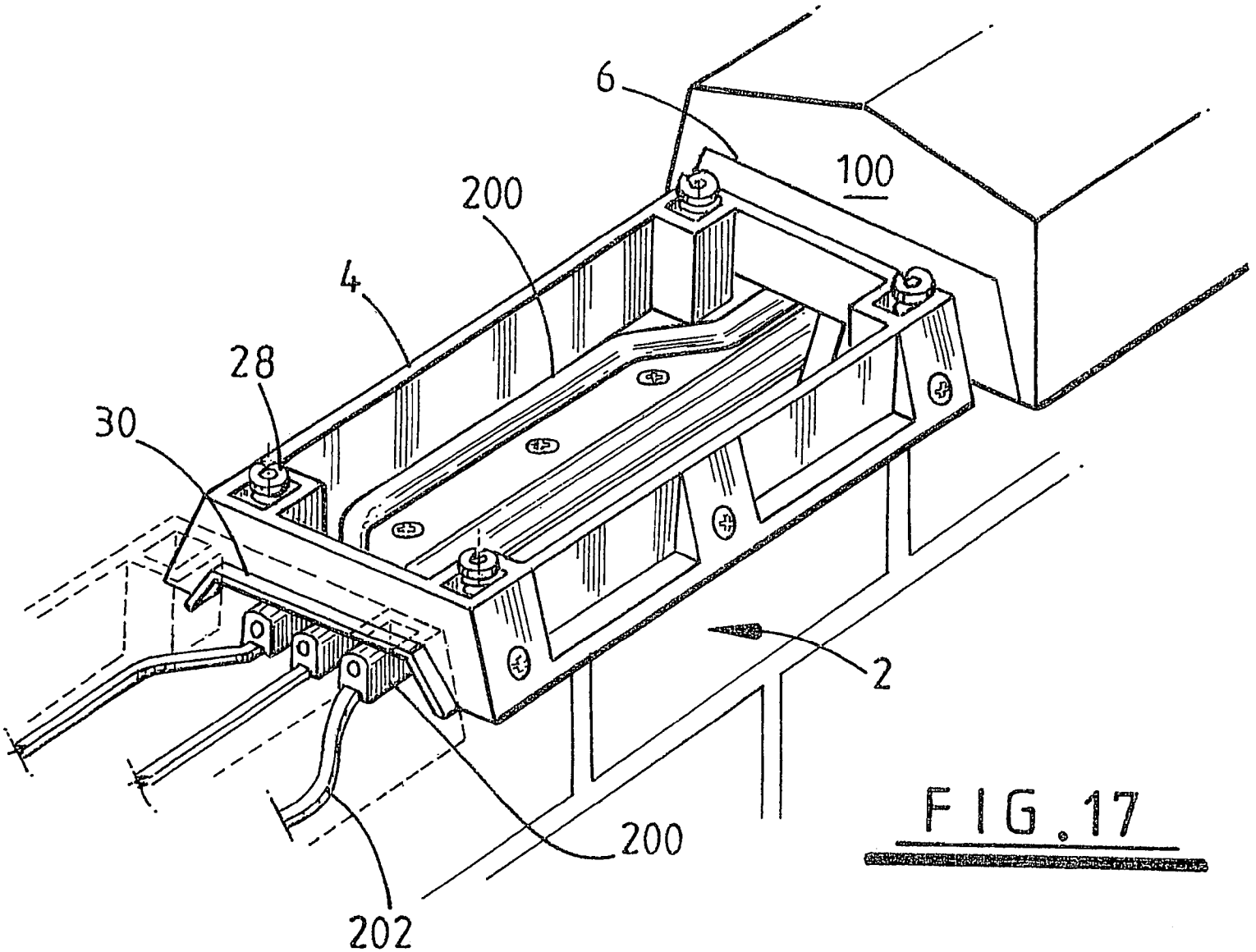
Figure 19:
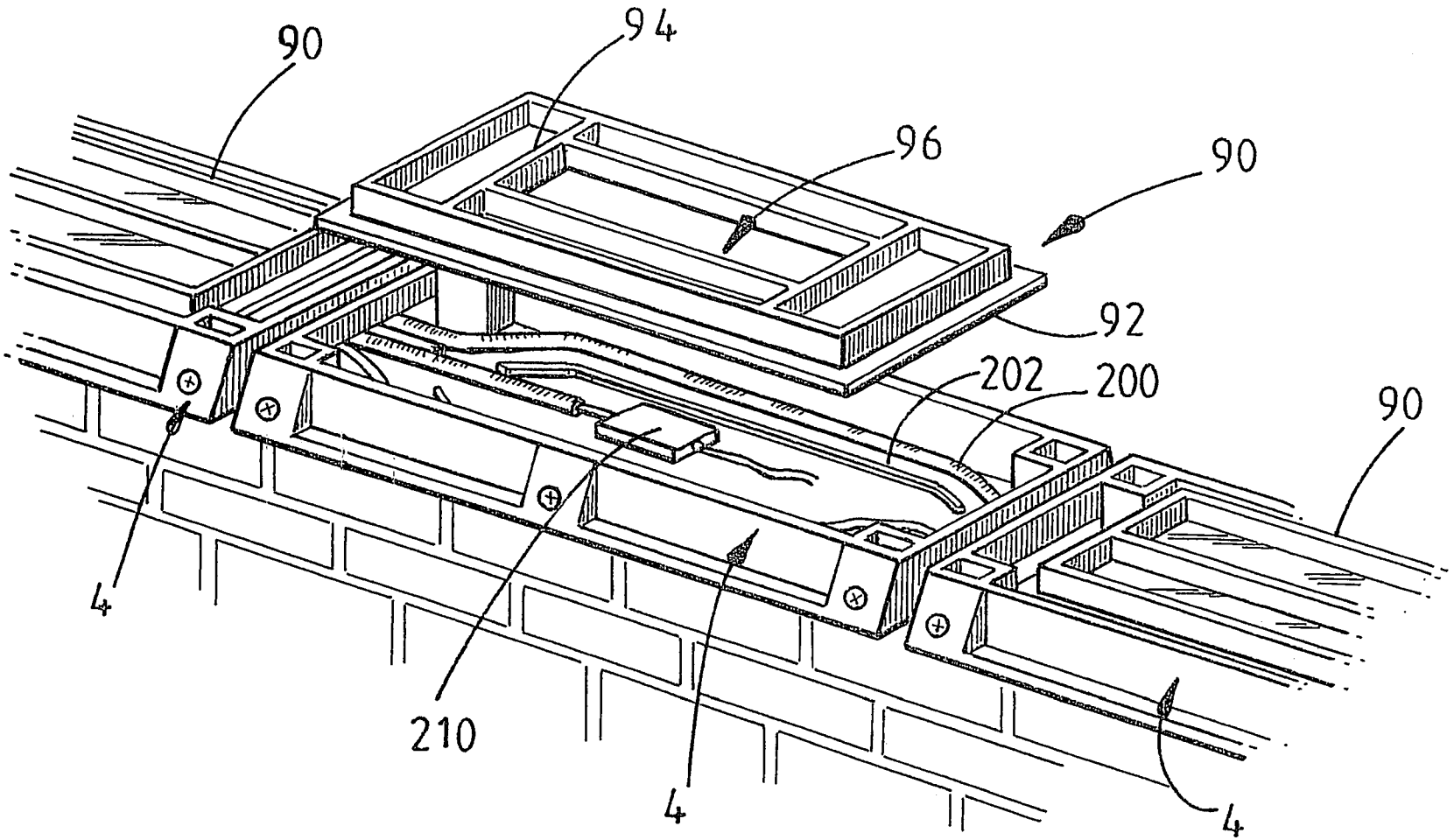
Figure 20:
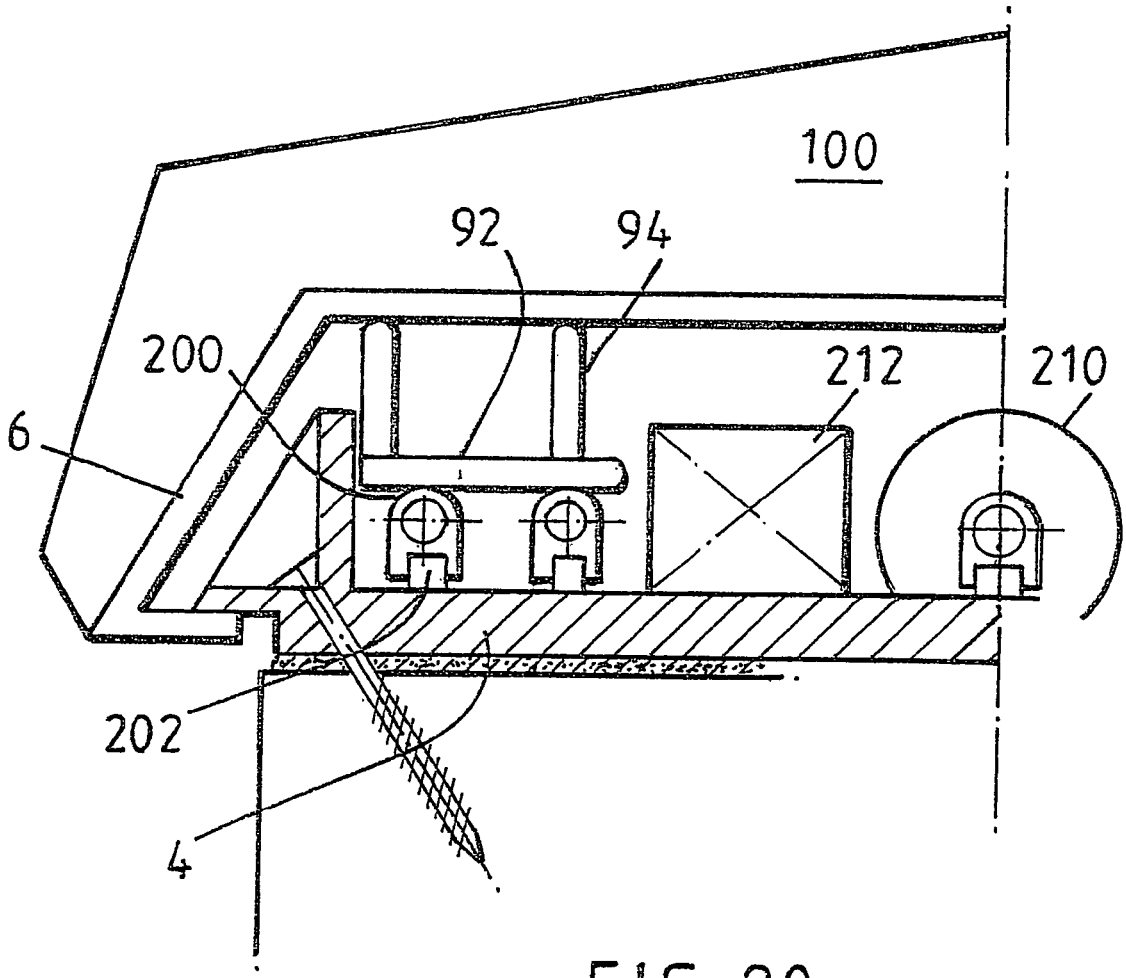
Figure 21:
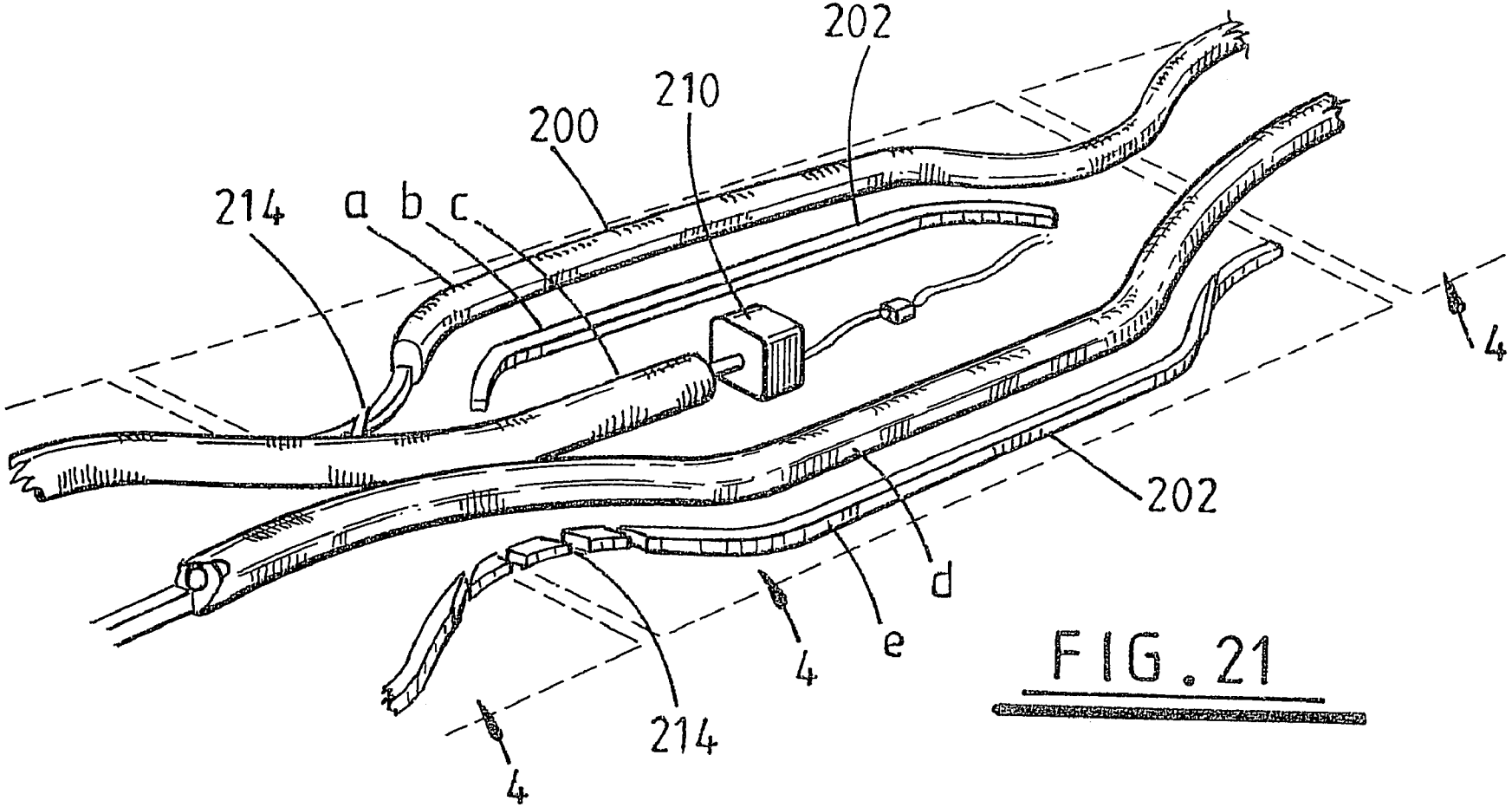

FIG. 15 is a cross-sectional diagram of one type of air tube for a security system according to the present invention;

FIG. 16 is a cross-sectional diagram illustrating the positioning of the air tube within one unit of a security system according to an embodiment of the present invention;

FIG. 17 is a perspective view of a base part of the present invention, illustrating the positioning of three air tubes within one unit of a security system according to a further embodiment of the present invention;

FIG. 18 is a cross-sectional view through a complete unit according to yet a further embodiment of the present invention;

FIG. 19 is a perspective view of the base part and bridging member of the unit shown in FIG. 18;

FIG. 20 is a cross sectional view through a complete unit according to still a further embodiment of the present invention; and FIG. 21 is a schematic perspective view of a base part containing an end of an airline.

Figure 1:
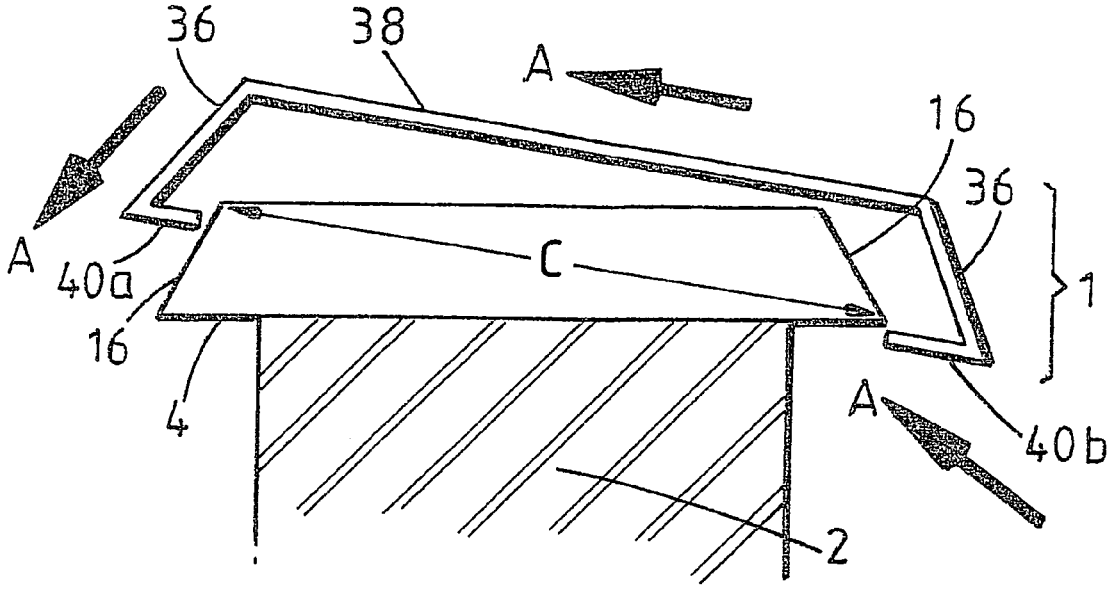
FIG. 1 is a cross-sectional simplistic view of one unit of a security system according to a first embodiment of the present invention, illustrating the mechanism for attachment of a top part to a base part.
Figure 2:
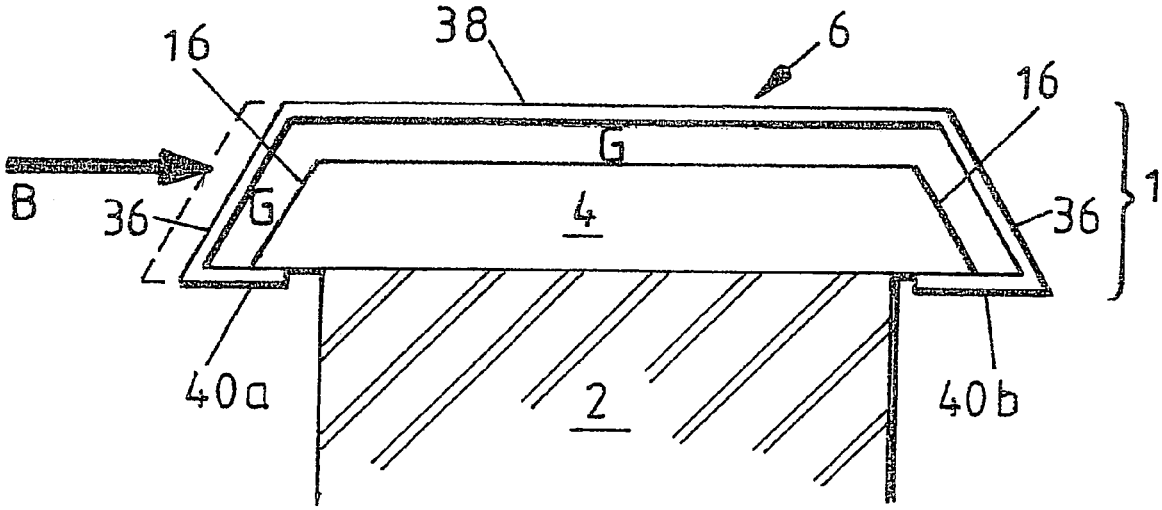
FIG. 2 shows the unit of FIG. 1 with the top part attached to the base part.
Figure 3:
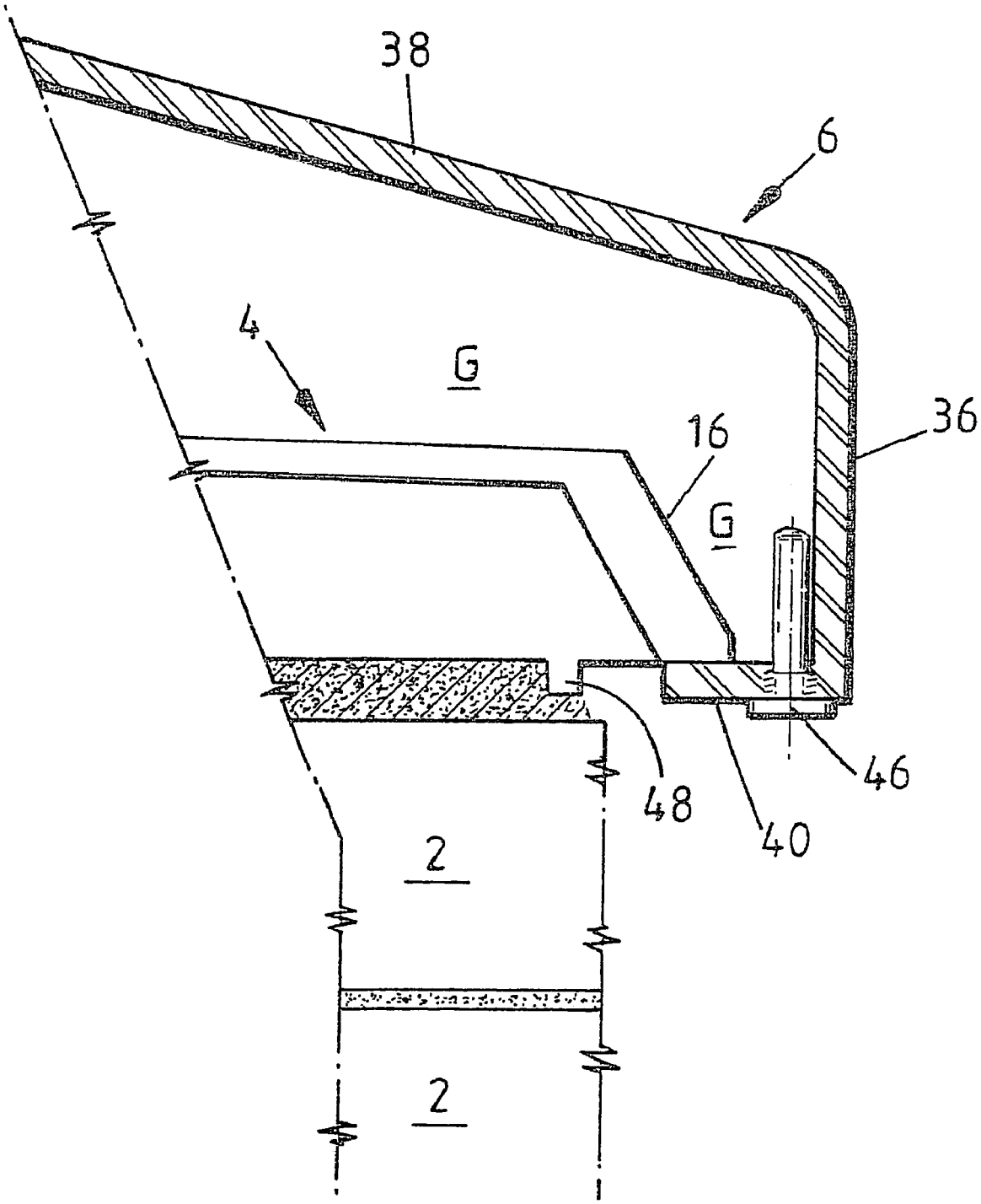
FIG. 3 is a detailed cross-sectional diagram of the unit shown in FIGS. 1 and 2 illustrating the securement of the top part to the base part.
Figure 4:
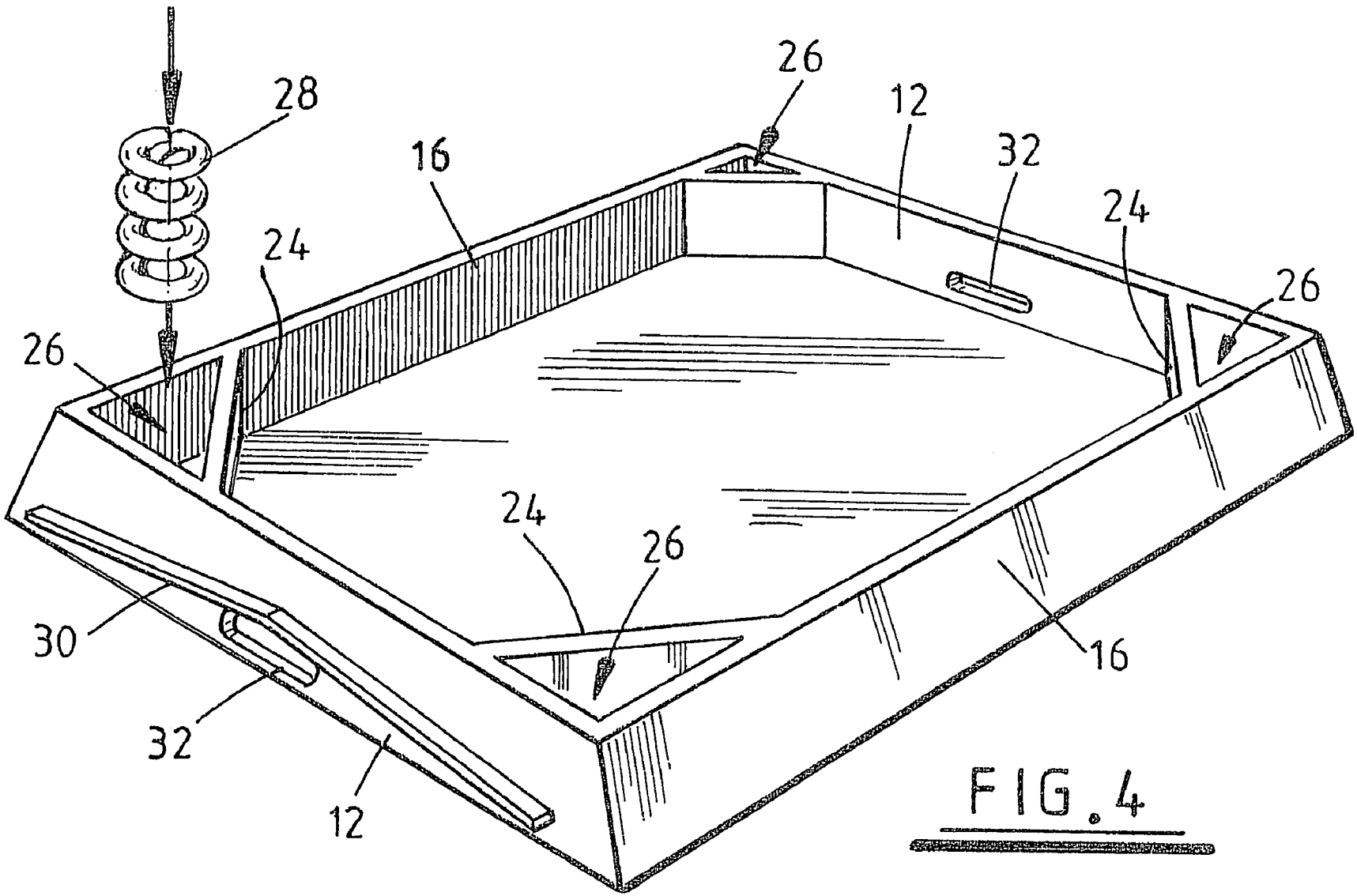
FIG. 4 is a perspective view of a base part for a unit of a security system according to a first embodiment of the present invention.

FIGS. 1 to 3 of the accompanying drawings illustrate a security system for installation around perimeter walling 2. The system is made up of multiple modular units 1 that fit together to cover the top of a wall or other perimeter barrier, such as a fence. Each unit 1 of the illustrated security system comprises two parts, a base member 4 and a top member 6 which are mounted on to the top surface of a wall. The top member 6 is constructed such as to fit over the base member and have a limited range of movement in any plane with respect thereto. The interior of the assembly. contains means for detecting this movement which generates a signal for activation of an appropriate alarm. The detecting, means are not shown in FIGS. 1 to 3 for the sake of simplicity.

Figure 5:
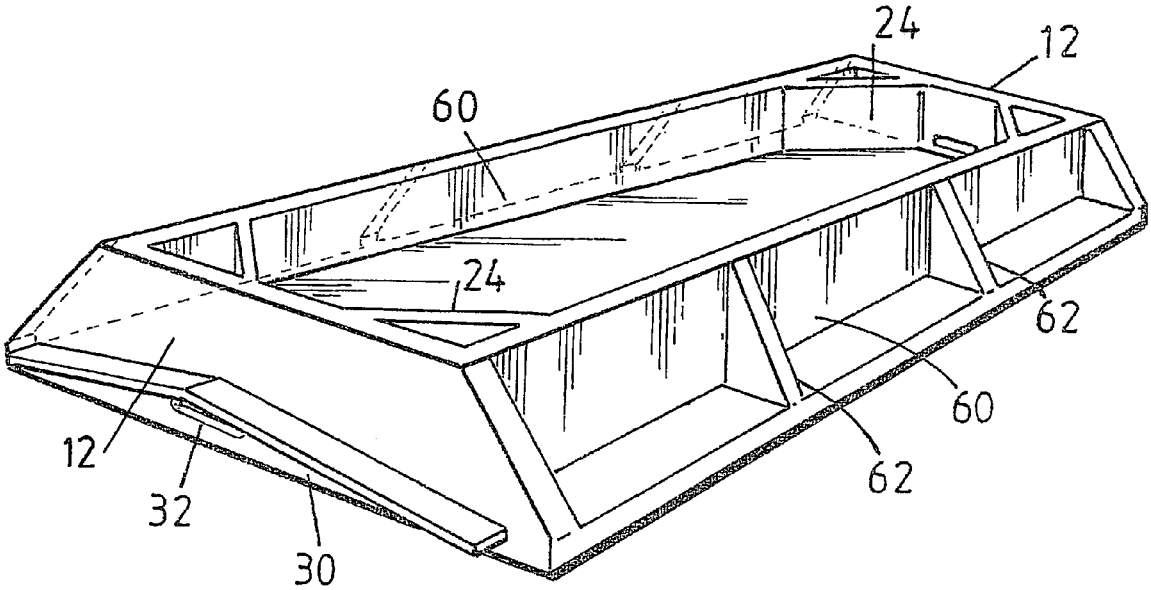
FIG. 5 is a perspective view of a base part for a unit of a security system according to a second embodiment of the present invention.
Figure 6:
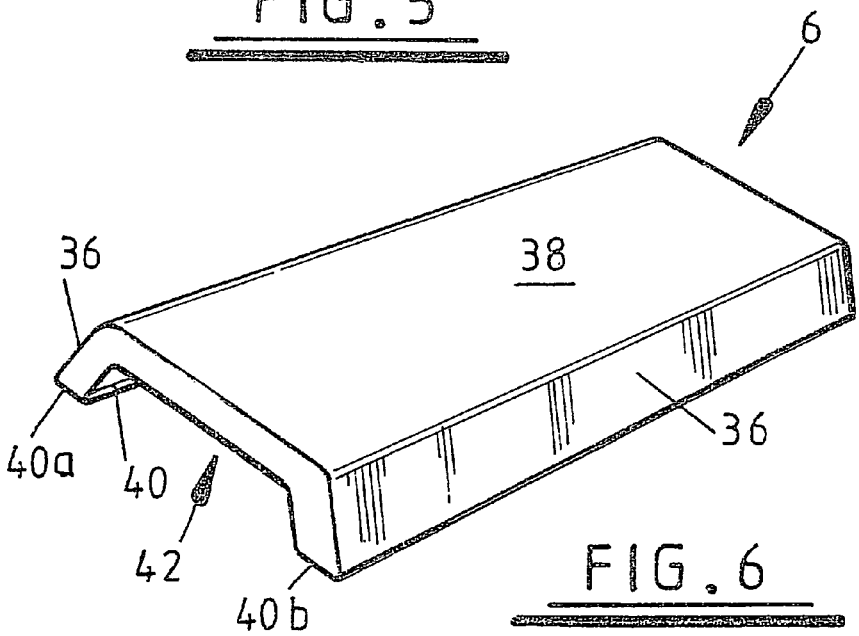
FIG. 6 is a perspective view of a top part for a unit of a security system according to a first embodiment of the present invention.

Referring to FIGS. 1 to 5 of the accompanying drawings, a first part comprises a base member 4 having two end walls 12 connected by side walls 16. Each end wall of the base member forms a trapezium with each sidewall extending from the non-parallel edges of the trapezium thereby defining a rectangular lower part and a rectangular upper part, the lower part being of a greater area than the upper part. The lower part of the base member is in general dimensioned to be of a similar width to the width of the top of the wall onto which it is to be mounted. The lower part is provided two parallel projections 48 that extend from the base and run along the length thereof. The projections are separated by a gap substantially equal to the width of the wall upon which the unit is to be placed. This enables the projections to abut the edge of the wall when the unit is installed (see FIG. 3). A flange 24 extends diagonally across each corner of the base member between adjacent end and side walls to form four triangular compartments 26 for housing springs 28. Each end wall of the base member is also provided with a V-shaped lip 30 for drainage purposes and an oval hole 32 through which electrical cables or beams/air-tubes will pass from one unit to another. The base member may be attached directly to the wall or other perimeter barrier or indirectly, for example, being mounted on a flat block that is attached to the wall. Adjustable locking bolts (not shown) or other conventional fastening means may be used to attach the base member to the wall top. A layer of quick setting cement or resin may be spread over an uneven wall top to allow accurate alignment of the base member thereon. FIG. 5, wherein identical features to those shown in FIGS. 1 to 4 are given the same reference numerals, illustrates how the base member may be provided with side walls 60 that have strengthening supports 62 at spaced apart intervals.

The top member 6 is dimensioned to fit over the base member 4, see FIGS. 1 to 3 and 6 of the accompanying drawings. The top member comprises two sloping sidewalls 36 connected by a roof section 38. Additionally, a rim 40 extends from the free edge of each side wall, the rims running parallel with the roof section 3 8 and defining an opening 42 to enable the top member to be placed over the base member (see FIG. 1). One of the rims 40*a* is narrower than the opposing rim 40*b* which is provided with a bore hole 44 for receiving a bolt 46 (see FIG. 3) to secure the top member with respect to the base member in the assembled unit.

The top member 6 is fitted over the base member 4 by engaging its wider rim 40*b* with the lower edge of one side of the base member and lifting the top member thereover. In this respect, it is important that the opening 42 is larger than the widest cross-sectional area of the base member (i.e. being the diagonal distance between the bottom corner and opposing top corner of the base member—illustrated by the line C in FIG. 1) to enable the top member to be placed thereover. The top member is then pulled out and pushed down over the opposing side of the base member to enable the other rim 40*a* to engage with the lower edge of the other side of the base member, as illustrated by the arrows A in FIG. 1. In this respect, it is also important that the opening 42 is less than the width of the base of the base member to enable the top member to be retained by the base member. Security screws are then inserted to prevent the top member from being removed (not shown in FIGS. 1 and 2). The opening 42 is greater than the width of the wall and the top member is larger than the base member to provide an internal gap G thereby enabling the top member to have a limited degree of lateral movement with respect to the base member, as illustrated by arrow B in FIG. 2. Additionally, the springs 28 that are located within the compartments 28 of the base member allow vertical movement of the top member with respect to the base member. Means for detection of any movement are provided within the internal cavity of the unit (see further details below).

In the embodiment illustrated in FIGS. 1 to 3, the inner profile of the top member is identical to its outer profile. However, it is to be appreciated that it is only the configuration of the inner profile that is important in enabling the top member to engage with the base member. The actual configuration of the base and top members may also be different to that shown in FIGS. 1 to 6. The essential feature is that the internal profile of the top member is able to engage with the external profile of the base member in such a manner as to allow a limited range of movement relative to each other without the two becoming readily disengaged. This provides a security device containing a minimal number of working parts and that is easy to install which is able to detect movement in at least two planes.

The attachment of the top member to the base member requires force to push the top member over the edge of the base member and to compress the springs held therein. This results in the top member, when fully assembled, being under a constant and equal pressure from the springs below. This will allow the unit to "stiffen" and yet still retain enough movement in the springs to an enable an alarm to be triggered if the unit is depressed or pushed.

Figure 7:
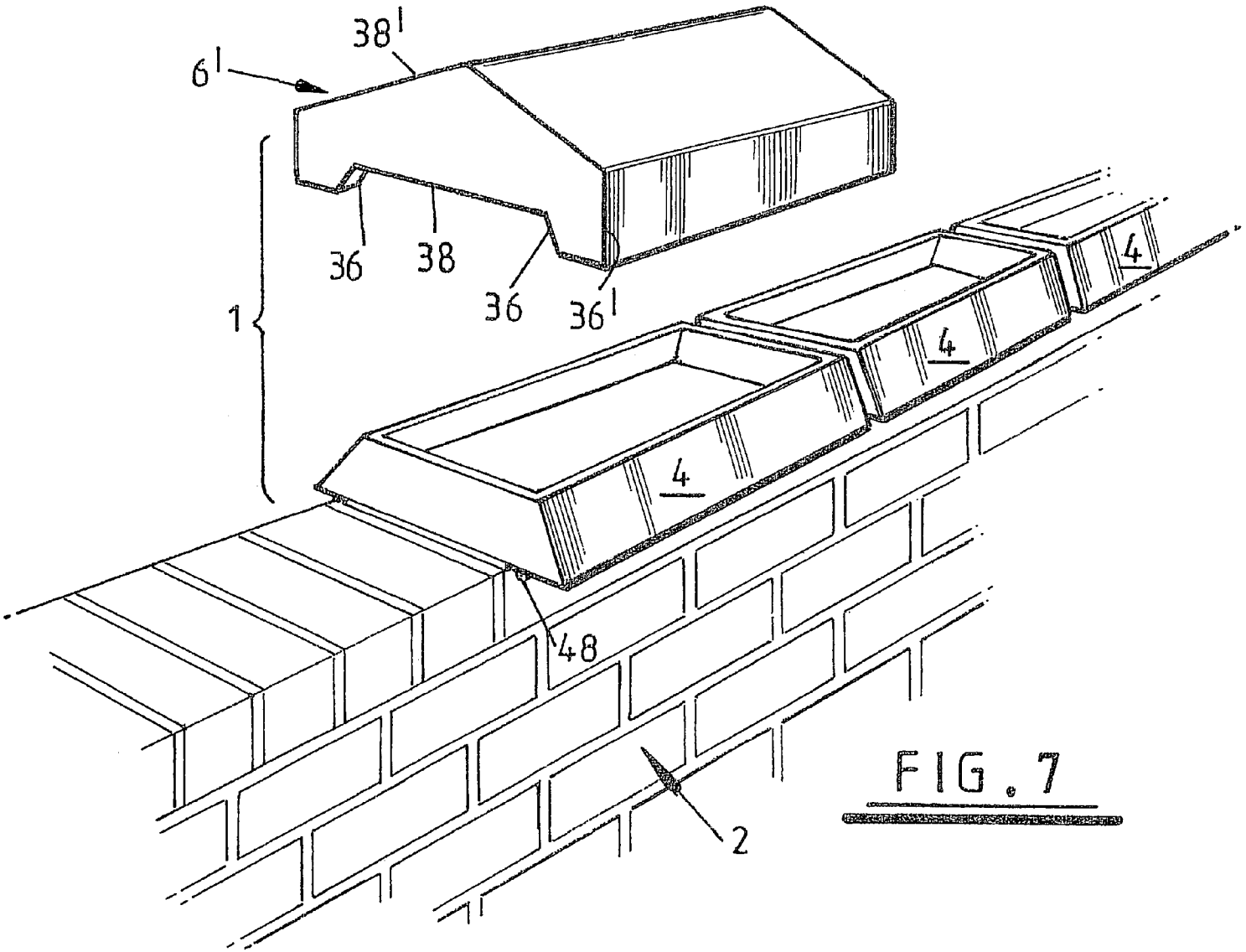
FIG. 7 is a perspective view illustrating multiple base parts and a top part of a unit of a security system according to a second embodiment of the present invention, shown attached to a wall.
Figure 8:
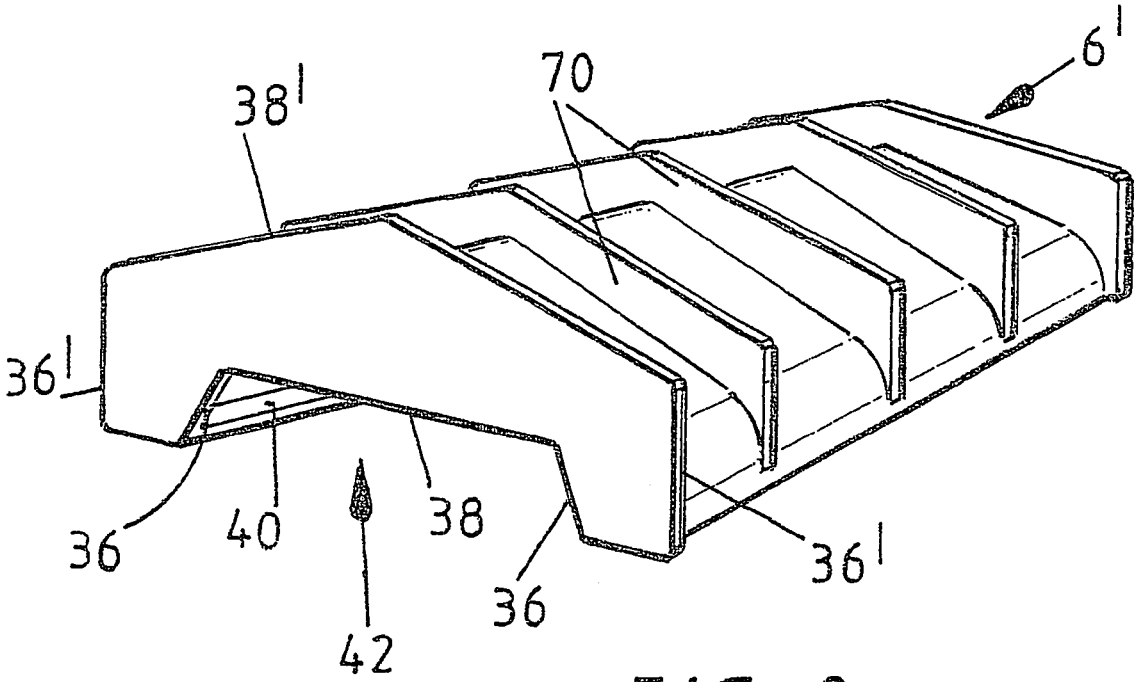
FIG. 8 is a perspective view of the top part shown in FIG. 7.

FIGS. 7 and 8 of the accompanying drawings illustrate how the top member 6' may be provided with a V-shaped roof section 38' to provide a wall top device that is aesthetically pleasing in that it mimics the shape of a conventional wall top. The inner side walls 36, 38 still correspond to the outer profile of the base member but the outer side walls 36' do not slope and are connected by the V-shaped roof section 38'. This type of top member may be provided with reinforcing ribs 70 at spaced part intervals, as shown in FIG. 8, to ensure that member is able to withstand large weights being applied to it. FIG. 7 also illustrates how multiple adjacent units 1 are attached to a wall top to ensure complete coverage of the perimeter wall.

Figure 9:
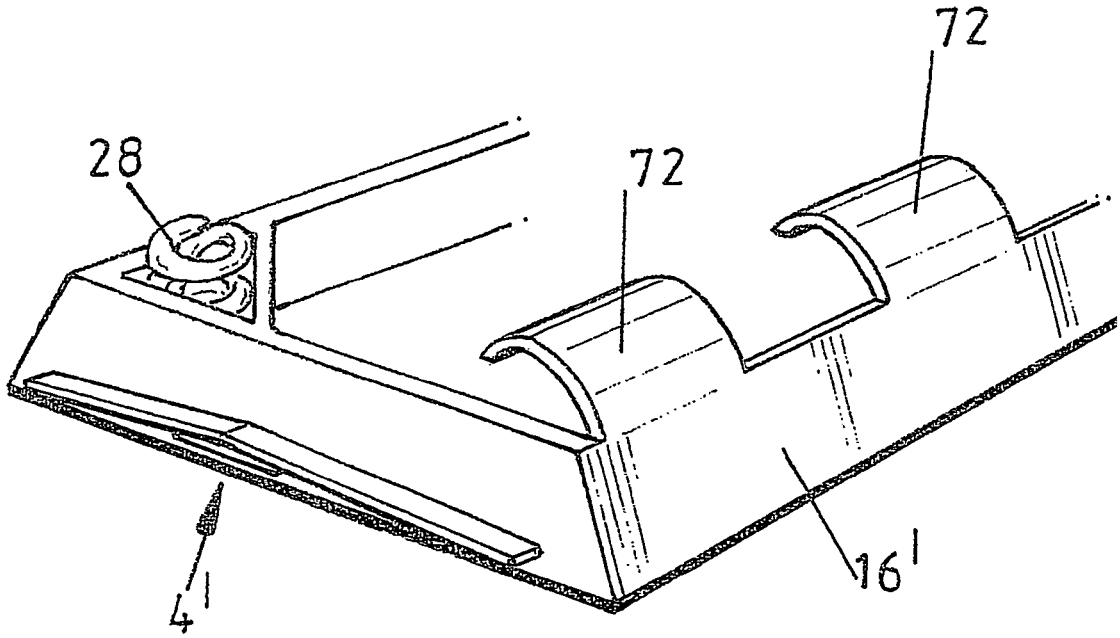
FIG. 9 is a part perspective view of a base part according to a third embodiment of the present invention.

FIG. 9 illustrates how the base member 4' may be provided with integral means for allowing its compression when force is applied with respect to the top member. The upper edges of the side walls 16' are provided with projections 72 extending upwardly that curve inwardly to allow a certain amount of "give" within the base member thereby enabling the base member to have to limited range of vertical movement when force is applied thereto. It is to be appreciated that this would remove the need for springs 28 but that the projections would need to be comprised of a material that would not deform or break under the pressure applied. Therefore, the projections should be of a material having a degree of elasticity and/or compressibility. Alternatively, plastic wishbones may be used in place of the springs 28.

Figure 10:
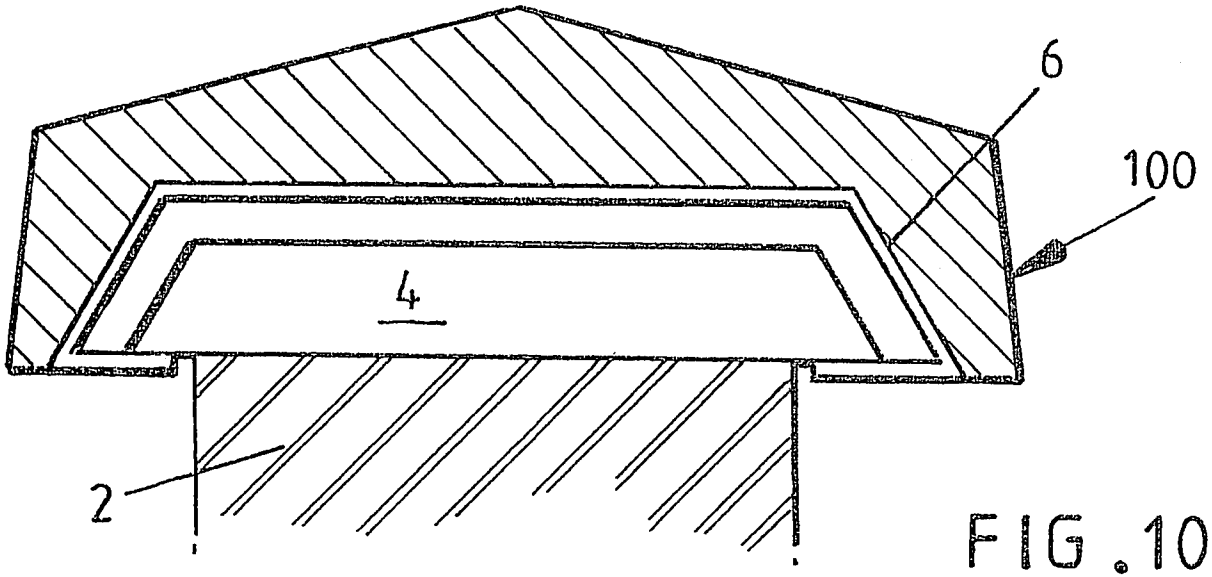
FIG. 10 is a simplistic cross-sectional diagram of one unit of a security system according to the third embodiment of the present invention.
Figure 11:
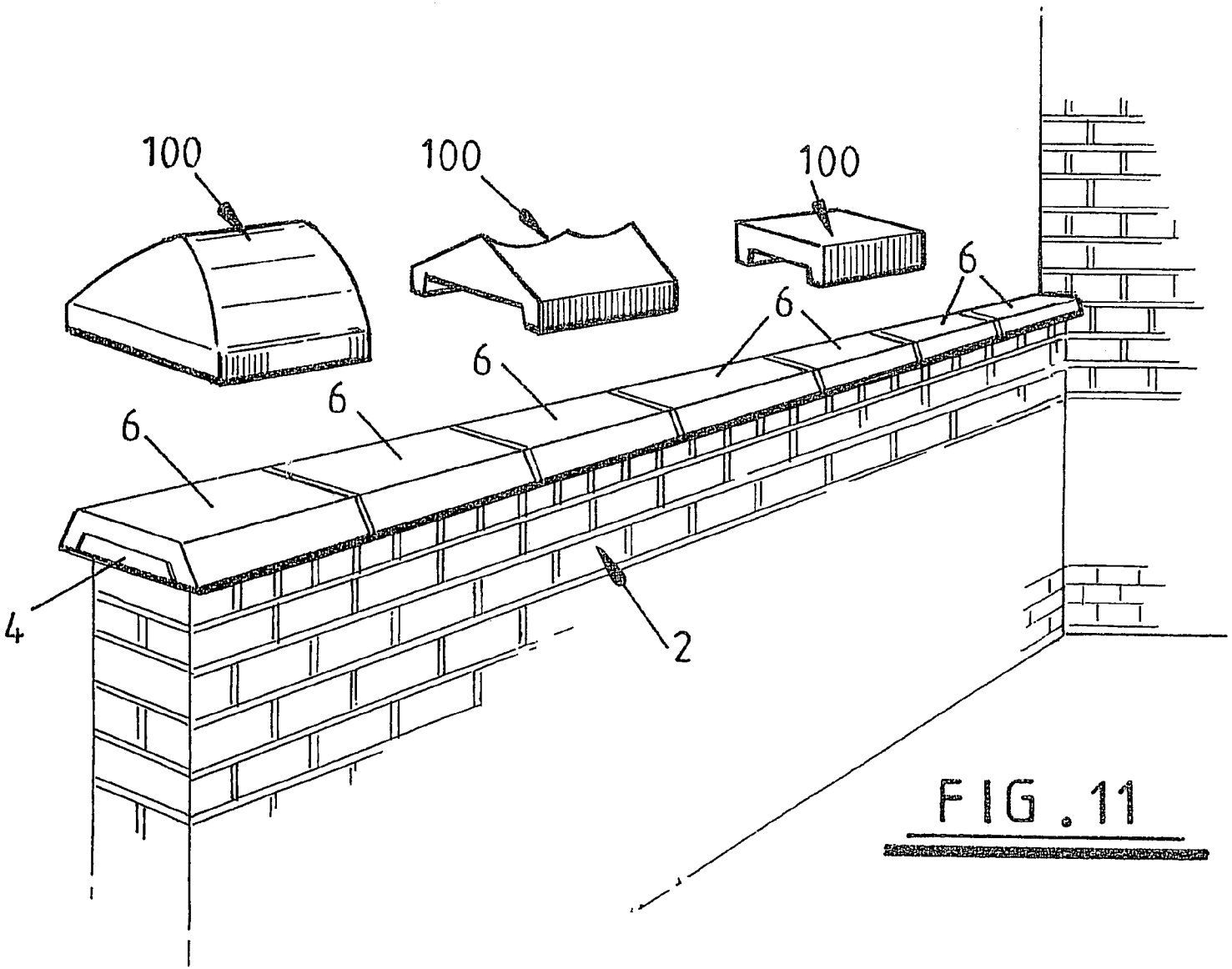
FIG. 11 illustrates three different types of cover parts for a security system according to the present invention.

FIGS. 10 and 11 illustrate how a further cover 100 or shroud may be provided for attachment over the top member 6. The inner profile of the cover 100 corresponds to the outer profile of the top member so that the cover can lie on top of, and abut, the top member. Suitable fixing means are provided to attach the cover to the top member (not shown). Preferably, the cover may be attached to the top member by means of a snap-fit connection. In this manner, the cover may be provided with an external profile in any appropriate design but having an inner profile to match the standard shape of the top member. This enables the base and top members to be produced to a standard design with the end user choosing a particular design of cover depending upon the desired look for their wall or fencing. Preferably, the base member and top member are made of a transparent, tough and durable material, such as high impact Perspex™ to enable the internal workings of the security system to be viewed therethrough. However, any suitable material may be used depending upon the intended application and/or location such as steel or alloy. The cover of the security system may be made of any suitable material such as a plastics material, stone, a stone effect resin or metal to compliment the surrounding architecture. For example, the ridge of the top member or cover may be provided with decorative edging or the like.

The ability of the unit to allow a certain degree of lateral and vertical movement and then recover its position enables such movement to be used to detect any physical pressure which is exerted on the unit and accordingly, the wall beneath. Thus, if an intruder mounts the wall and pushes the security unit in either the vertical or horizontal plane, this movement may be used to activate an alarm. The various components for detection of any movement of the parts of the unit and for activating one or more alarms may be contained within the cavity provided by the top and/or base parts and thus will be protected from the external environment and be hidden from view, except for the option of hardwiring for external power. Additionally, there is easy access to the installed equipment by removal of the top part only.

Figure 12:
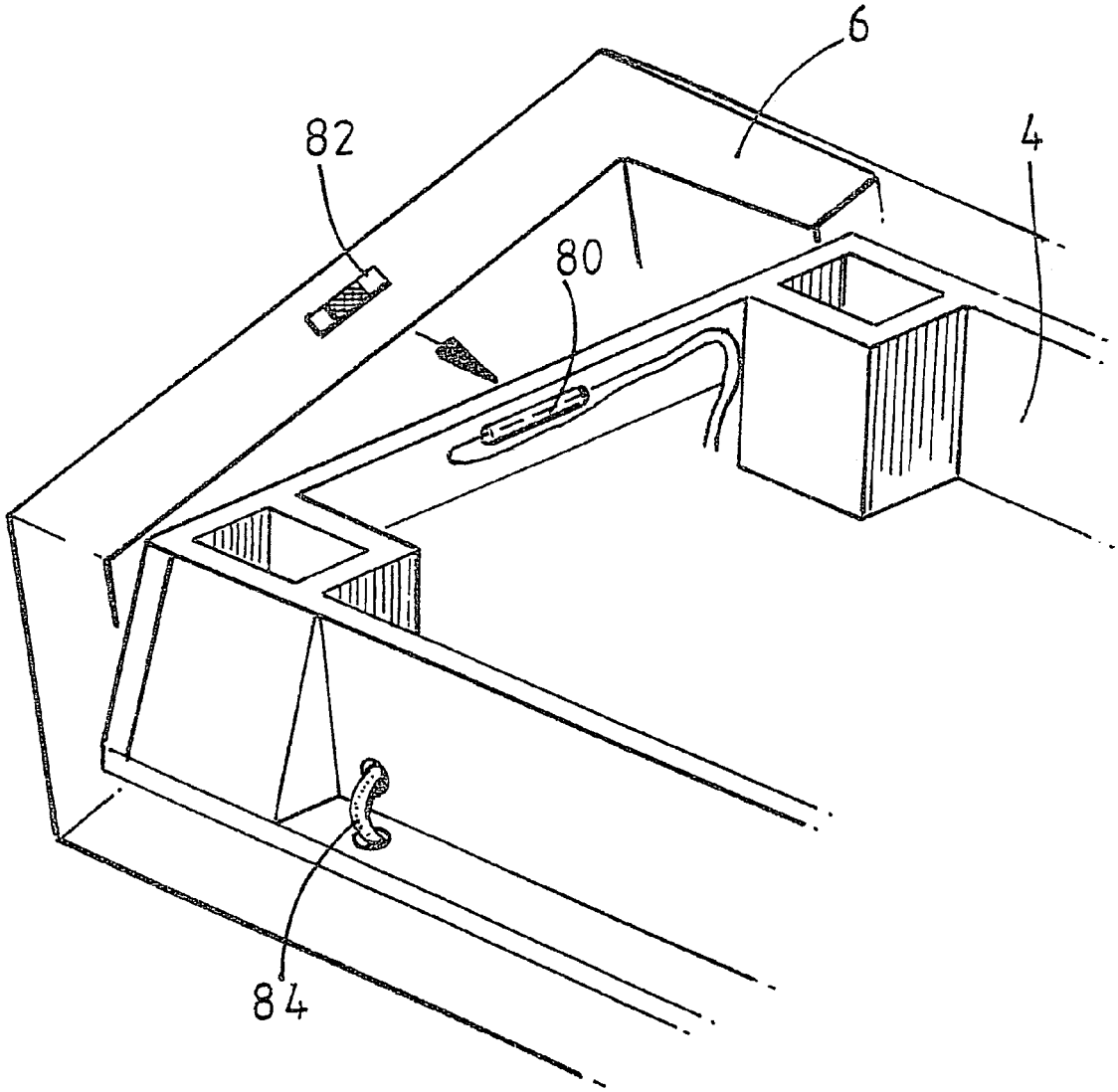
FIG. 12 illustrates one type of detector means provided in a security system according to the present invention.

Various mechanisms may be employed for detection of the movement and activation of a suitable alarm. For example, magnetic contacts may be used which then send an electrical impulse to activate an alarm, or microswitches may be. provided within suitable circuitry. FIG. 12 illustrates how the base part 4 may be provided with a-reed switch 80 which contacts a magnet 82 provided at a corresponding location of the top member 6. Only one reed switch and magnet is shown in the illustration but it is to be appreciated that a number of devices may be located at different positions to operate as a tamper switch, detecting any movement across the wall or downwards. A neon light 84 is also provided on the base member, being visible through the transparent top member. A wide range of other conventional devices may also be used, such as electrical wiring, tilt switches, junction boxes, solar power units, battery packs, airline activated devices. Detection may activate an audible alarm that is released through the speakers contained within the unit and/or illuminate the lights contained on the sides of the unit. The system may also be linked to an internal alarm system within the property or to a central observation point.

Figure 13:
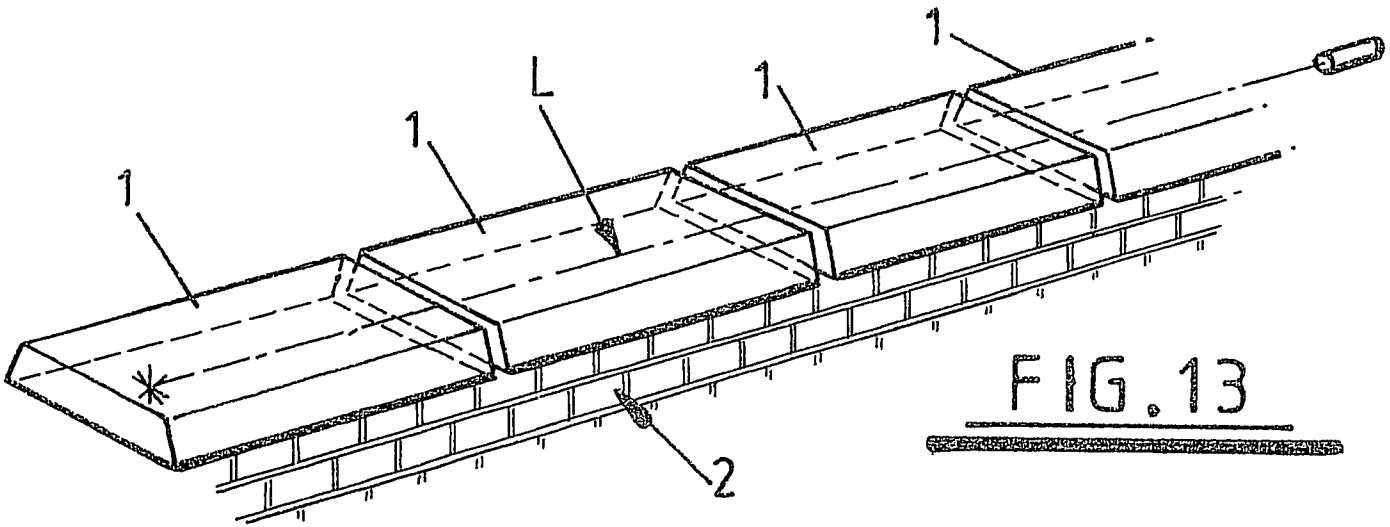
FIG. 13 illustrates an alternative type of detector means provided in a security system according to the present invention.

Alternative means may be provided within the unit for detection of movement of the top member with respect to the base member. For example, a laser beam L may be used wherein any movement interferes with the passage of the beam which is detected by an appropriate detector connected to an alarm (as illustrated in FIG. 13) or the laser beam unit may be mounted on a spring whereby movement of the unit activates an alarm. Alternatively, electronic pads load cells and/or strain gauges may be held within the base member to detect any force applied to the top member. In this case, a Smart box would be required which would know the weight of the top member and/or cover and which could detect any increase in weight applied thereto. The alarm would be triggered only when a weight above a certain threshold was detected, thereby preventing the alarm being set off by, for example, a cat walking along the wall.

Another way in which the unit may trigger an alarm is by using rectangular rubber bellows or hollow blocks that are connected together and, once pressurized with air inside, support the top member and cover. The pressure inside the units (allowing for temperature variants) would then be constant. A smart box and pressure switch activate an alarm when a set pressure is reached, for example, system pressure +15 kilos (i.e. allows the wall top to receive cats, snow etc; without setting off the alarm). Any tampering of the units would result in a loss of pressure which would also give rise to an alarm status.

In a preferred embodiment of the present invention, an airtube or airline 200 is used to detect any force applied to the top member and/or cover of the security unit. FIGS. 14*a* to 16 of the accompanying drawings illustrate the installation of an air tube within the base member of the unit according to one embodiment of the present invention. The base member 4" is provided with a series of parallel beams or guides 202 between its end walls extending along its longitudinal axis, each beam having an indent 204 at each end thereof The air tube 200 has a main body 207 and a connector 208 wherein the main body forms a substantially cylindrical tube and the connector is in the form of an inverted U-shaped projection extending from a region of the tube along the length thereof (see FIG. 15). The air tube is installed so as to lie on top of each beam, being connected thereto by means of the U-shaped projection, as shown in FIG. 14*b*. The indents 204 at the end of each beam enable the tube to be directed onto an adjacent beam. It is to be appreciated that the dimensions of the air tube are such that the upper surface of the tube contacts the inner profile of the top member 4 such that any movement exerted on the top member (in either the horizontal or vertical plane) distorts the tube held within the base member, as shown in FIG. 16.

Alternatively, instead of having the air tube in direct contact with the top member, a bridging member 90 may be provided comprising a flat base 92 having a series of upright projections 94. The base is dimensioned to fit snugly within the base member 4 on top of the airtubes 200 and the projections are dimensioned such that they come into contact with the inner surface of the top member 6. The bridging member is unable to move sideways with respect of the base member but can move downwardly to impart pressure on the airtubes. This arrangement prevents the airtubes 200 being dislodged from the beams/guides 202 by movement of the top member 6.

A number of separate units may be interconnected side by side to extend around the perimeter of a property or alternatively, a unit may be made to fit a particular length of wall. It is to be appreciated that the former would be preferable due to its ability to be adapted to fit any perimeter walling. The installation of a security system to a perimeter wall which extends around an entire property will require modification of the unit at the junction of two or more walls and at an end wall. Examples of such modifications are described in the Inventor's earlier GB Patent No. GB2349727, the contents of which are incorporated herein by reference. It is to be appreciated that the attachment would have to be adapted should only one side of adjacent properties wish to install the security system of the present invention. For example, the unit 1 may be modified to form a half unit for spanning half of a wall top. The units should be connected together in a manner such as to prevent tampering between the units, for example, metal strips could be placed over the junction of two units to create a seal. Alternatively, other anti-vandal mechanisms known in the art may be incorporated into the system.

FIGS. 19 to 21 illustrate how a security system that employs an airline may be adapted for installation on a long wall. In this respect, where multiple units 1 are to be installed along a long wall top, it will be necessary to include a number of air switches at intervals along the wall tops. Each air switch is provided at intervals in a base member 4. The air switch 210 is placed in the center of the base member and can be accessed through the bridging member due to the center thereof being relieved of material 96. In the illustrated embodiment, each base member 4 is provided with three air lines 200 which are attached to guides 202. A series of five guides are provided to enable the base member to accommodate an air switch 210. Generally, if the unit is to contain three airlines without an air switch, the airtubes are located on the two outermost guides (a, e) and the central guide c (see FIG. 17). However, in order for an outer airline to arrive at an air switch, it is possible to move the central airline onto the adjacent guide d and pass the outer airtube into the center by means of slots 214 provided in the guides. Another air tube may then be attached to the outer guide a. In this manner, each unit has sufficient air tubes to enable detection of any movement, regardless of whether one of the tubes terminates in an air switch in that particular unit.

Depending upon the type of means incorporated into the unit for detection of movement, each alarm unit of the perimeter security system may be provided with its own internal battery system (see, for example, the battery 212 in FIG. 20). The system may be self-charging, for example, being solar powered with a solar panel being fitted to the wall inside the protected area or fitted onto the enclosure itself. Additionally, each unit may have an external power lead to the batteries in order to maintain maximum charge. Each unit may also be provided with an electric controller in the interior thereof which has means to preset the audible and/or visible alarm to operate with a specified time in accordance with the legalisation of the local authority. A radio transmitter may also be installed, if required. An electrical panel for operation and control of the perimeter security system may be installed within a protected property, e.g. a house.

Whilst the present invention has been described in relation to its attachment to a wall, it is to be appreciated that the units may be installed on any type of perimeter barrier, such as a fence. This would require modification to the size and shape of the unit but the underlying concept would be the same.

The security system of the present invention provides an additional advantage in that the wall is protected from frost. The security unit is weather proof and rainwater is diverted away from the wall thereby preventing water entering the wall cavity that may freeze and thereby cause damage to the wall.

The present invention provides a security system which is completely out of sight since it is enclosed within a purposely designed, environmentally and aesthetically pleasing structure. The system has to be physically activated by a person climbing a wall which surrounds a property and thus should vastly reduce the number of false alarms. Furthermore, the alarm is raised before the intruder has chance to reach a person's home or property. The unit is also made of few working parts and may be fitted together easily. Moreover, the unit may be made from two main parts of a standard design for receiving covers made to multiple designs, thereby enabling the end user to create a wall of a particular desired look. The simple construction of the unit also enables the parts to be easily interchanged, for example for repair and/or a change of design.

The invention claimed is:

1. A security system comprising an attachment for mounting on a wall or other perimeter barrier, the attachment having first and second parts, the first part having an underside that, in use lies on the wall or barrier top and being fixable to the wall or barrier and the second part being mounted for relative movement on said first part upon application of a force thereto whereby movement of the second part generates a signal to activate a visual and/or audible alarm, wherein the second part has at least one pair of opposing members for partially overlapping the underside of the first part so as to retain said second part, the second part being sized so as to allow a limited range of movement with respect to said first part without its release therefrom.

2. A security system as claimed in claim 1 wherein the second part is larger than the first part whereby, in use, a gap is created between said first and second parts.

3. A security system as claimed in claim 1 wherein the second part is moveable with respect to the first part in more than one plane.

4. A security system as claimed in claim 1, wherein means for generating the signal is housed within the interior of the attachment.

5. A security system as claimed in claim 1 wherein the first part has an upper side, an underside and opposing side walls whereby, in use, the underside lies on the wall or barrier top and the side walls run parallel with parallel edges of the wall or barrier top.

6. A security system as claimed in claim 5 wherein the underside is solid and the upper side is relieved of material or completely open to expose the interior of the first part.

7. A security system as claimed in claim 5 wherein the second part comprises opposing side walls connected by a roof section, the opposing members extending from the free end of each side wall whereby, in use, the opposing side walls lie parallel with the side walls of the first part and the members partially overlap the underside of the first part.

8. A security system as claimed in claim 7 wherein the second part is sized so as to provide a gap between the upper side of the first part and the roof section of the second part.

9. A security system as claimed in claim 7 wherein the second part is sized so as to provide a gap between the side walls of the first part and the side walls of the second part.

10. A security system as claimed in claim 1 wherein one of the opposing members of the second part is narrower than the other.

11. A security system as claimed in claim 5 wherein the first part has side walls connecting two end walls whereby, in use, the two end walls lie across the wall or barrier top and the side walls align with the edges of the wall or barrier top.

12. A security system as claimed in claim 11 wherein two parallel rims extend from the underside of the first part for abutting opposing edges of the wall or barrier.

13. A security system as claimed in claim 5 wherein the underside of the first part is wider than the wall or barrier on to which it is mounted such that the first part extends beyond the edges of the wall or barrier.

14. A security system as claimed in claim 5 wherein the first part is mounted on a mounting plate that is attached to the wall or barrier, the first part being wider than the plate.

15. A security system as claimed in claim 7 wherein the first part is provided with at least one spring or other compressible object extending upwardly therefrom for supporting the roof section of the second part.

16. A security system as claimed in claim 7 wherein the first part is constructed such as to provide an integral spring (72) for supporting the roof section of the second part.

17. A security system as claimed in claim 5 wherein the first part is in the form of a trapezoid with the side walls extending from the non-parallel sides of the trapezoid.

18. A security system as claimed in claim 17 wherein the second part comprises two sloping side walls connected by a roof section, each side wall having a rim (40*a*, 40*b*) extending from the free edge thereof defining an opening in the second part.

19. A security system as claimed in claim 18 wherein each rim runs parallel with the roof section.

20. A security system as claimed in claim 18 wherein one rim is wider than the opposing rim.

21. A security system as claimed in claim 18 wherein the opening is dimensioned such as to allow the second part to fit over the first part at a particular orientation but require force to interlock the two parts together.

22. A security system as claimed in claim 17 wherein the opening is dimensioned such as to allow the second part to fit over the first part at a particular orientation but require force to interlock the two parts together, and wherein the opening is larger than the widest cross-sectional area of the first part, being the diagonal distance between the bottom corner and opposing top corner of the first part, but is smaller than the base or underside of the first part thereby requiring force to allow engagement or disengagement of the second part.

23. A security system as claimed in claim 1 further comprising a third part in the form of a cover for attachment to the second part.

24. A security system as claimed in claim 23 wherein the third part has an inner profile that corresponds to an outer profile of the second part to enable the two parts to fit together.

25. A security system as claimed in claim 1 wherein the mechanism for detecting movement between said first and second parts is selected from at least one of a magnetic contact, laser, electronic pressure pad, micro switch, tilt switch, vibration/shock sensor, strain gauge and a load cell.

26. A security system as claimed in 1 wherein at least one air tube is provided between said first and second parts to detect movement therebetween.

27. A security system as claimed in claim 26 wherein the first part is provided with guides for receiving the air tube.

28. A security system as claimed in claim 27 wherein the air tube passes through a series of convolutions in each attachment.

29. A security system as claimed in claim 26 wherein the air tube is positioned such that an upper surface thereof contacts the inner profile of the second part at least at spaced apart intervals.

30. A security system as claimed in claim 26 wherein a bridging member is provided between said first and second parts to communicate movement of said second part to the air tube.

31. A security system as claimed in claim 30 wherein the bridging member sits within the first part and is unable to move laterally with respect thereto.

32. A security system as claimed in claim 27 wherein the air tube is in the general shape of a tube having an inverted U-shaped extension for attaching the tube to the guides.

33. A security system as claimed in claim 27 wherein more guides are provided in each first part than air tubes whereby, one air tube can terminate in an air switch and an additional air tube can be provided on one of the free guides.

34. A security system as claimed in claim 33 wherein at least some of the guides are provided with slots at or near an entry to and/or exit from the first part to enable air tubes to be moved from one guide to another.

* * * * *